US007631980B2

(12) United States Patent
Holten

(10) Patent No.: US 7,631,980 B2
(45) Date of Patent: Dec. 15, 2009

(54) LUMINAIRE AND A LIGHTING PANEL FOR A LUMINAIRE

(75) Inventor: Peter Holten, Winterswijk (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 95 days.

(21) Appl. No.: 11/912,318

(22) PCT Filed: Apr. 25, 2006

(86) PCT No.: PCT/IB2006/051282

§ 371 (c)(1),
(2), (4) Date: Oct. 23, 2007

(87) PCT Pub. No.: WO2006/114763

PCT Pub. Date: Nov. 2, 2006

(65) Prior Publication Data

US 2008/0205065 A1 Aug. 28, 2008

(30) Foreign Application Priority Data

Apr. 26, 2005 (EP) ..... 05103376

(51) Int. Cl.
*F21V 5/00* (2006.01)

(52) U.S. Cl. ..... 362/97.1; 362/97.4; 362/311.01; 362/311.06; 362/330; 362/360

(58) Field of Classification Search ..... 362/97.1, 362/290, 330, 354, 97.2, 97.3, 97.4, 327, 362/351, 360, 311.01, 311.06
See application file for complete search history.

(56) References Cited

U.S. PATENT DOCUMENTS

| | | | | |
|---|---|---|---|---|
| 2,398,624 | A * | 4/1946 | Decker | 362/342 |
| 2,434,049 | A | 1/1948 | Nordquist | |
| 2,859,334 | A | 11/1958 | Guth | |
| 3,234,376 | A | 2/1966 | Ceglia | |
| 3,265,887 | A | 8/1966 | Wince | |
| 4,069,417 | A | 1/1978 | Howe | |
| 6,238,065 | B1 * | 5/2001 | Jones | 362/339 |
| 6,698,909 | B2 * | 3/2004 | Jones | 362/339 |
| 2002/0080602 | A1 | 6/2002 | Jones | |

FOREIGN PATENT DOCUMENTS

| | | | |
|---|---|---|---|
| DE | 2748947 | A1 | 5/1979 |
| GB | 878215 | A | 9/1961 |
| WO | 2005083317 | A1 | 9/2005 |

* cited by examiner

*Primary Examiner*—Thomas M Sember

(57) ABSTRACT

A luminaire comprising a light source and a lighting panel in front of the light source, wherein light radiation from the light source is transmitted through the lighting panel before it leaves the luminaire. The material of the lighting panel is transparent, and the front surface of the lighting panel is profiled in order to reduce outgoing light radiation that is at a relatively small angle to the plane of the lighting panel. Walls (7, 8) of a less translucent material are embedded in the transparent material of the lighting panel, which walls (7, 8) extend substantially perpendicularly to the plane of the lighting panel.

8 Claims, 2 Drawing Sheets

LUMINAIRE AND A LIGHTING PANEL FOR A LUMINAIRE

The invention relates to a luminaire comprising a light source and a lighting panel in front of the light source, wherein light radiation from the light source is transmitted through the lighting panel before it leaves the luminaire, wherein the material of the lighting panel is transparent, and wherein the front surface of the lighting panel is profiled in order to reduce outgoing light radiation that is at a relatively small angle to the plane of the lighting panel. The front surface (or outer surface) of the lighting panel is the side of the lighting panel facing away from said light source.

The lighting panel is a plate of transparent plastic material or any other transparent material, and is made, for example, of polymethylmethacrylate or polycarbonate. A profiled surface means that at least one side of the lighting panel is provided with a certain pattern of recesses and/or protrusions such that a major portion of the transmitted light radiation issues from the lighting panel within a predetermined zone in front of the luminaire. Such a translucent lighting panel is disclosed in GB-A-878215, where one side of the lighting panel is provided with a pattern of recesses. These recesses may have a conical shape or a pyramidal shape, and the base of the pyramid may be an equilateral triangle or a square, or may have some other shape.

In particular, such a luminaire is used for lighting an office or other large room, where the luminaire can be mounted in a recess in the ceiling or against the surface of the ceiling, or be suspended from the ceiling. The lighting panel then forms the lower side of the luminaire, through which side the light issues from the light source inside the luminaire into the office or room. The light from the luminaire radiates not only in the vertical downward direction, but also in directions enclosing an angle with the vertical direction. Therefore, the luminaire illuminates an area that may be much larger than the dimensions of the luminaire itself. However, if the radiation of the light from the luminaire is at a wider angle to the vertical direction, i.e. the angles between the light rays and the surface of the ceiling are small, then such radiation of the light is inconvenient for persons at some distance from the luminaire. To avoid such inconvenience, the office should be illuminated by a number of luminaires distributed over the ceiling, each luminaire illuminating a portion of the office below the luminaire, while light radiation at a small angle to the surface of the ceiling is avoided.

A good luminaire for illuminating an office directs the emitted light radiation in such way that the intensity of the light below the luminaire is more than the intensity of the light further away from the luminaire. Neighboring luminaires can thus produce a uniform luminous intensity over the entire area below a number of luminaires. However, light rays from the luminaires must not have directions at small angles to the surface of the ceiling in order to avoid inconvenience for the persons in the office.

In order to reduce such inconvenient light radiation from the luminaire, the outer side (front) of the lighting panel of the luminaire is provided with said profiled surface such that at least half of that surface is positioned at angles between 20° and 50° to the plane of the lighting panel. The transmitted light radiation will then mainly issue within a predetermined zone below the luminaire, i.e. the light rays have mainly directions at relatively small angles to the direction perpendicular to the plane of the lighting panel. Light radiation at relatively small angles to the plane of the lighting panel is minimized thereby. Experiments have shown that such a lighting panel provides a comfortable light distribution, provided that the luminance of the light radiation from the luminaire is not high. A relatively high luminance of the luminaire, however, may cause glare for observers further away from the luminaire owing to light radiation being directed at a relatively small angle to the plane of the ceiling.

The use of the described lighting panel will cause the major portion of the transmitted light to be directed into the predetermined zone, and when an optimal shape of the surface of the outer side of the lighting panel is used, then almost all light radiation will be directed into the predetermined zone. However, there will always remain some undesired light radiation directed at a relatively small angle to the plane of the lighting panel.

The object of the invention is a luminaire comprising a light source and a lighting panel in front of the light source, wherein the outer side (front side) of the lighting panel has a profiled surface in order to direct the transmitted light radiation mainly into a predetermined zone, wherein the light radiation is at relatively small angles to the direction perpendicular to the plane of the lighting panel, and wherein light radiation at small angles to the plane of the lighting panel is reduced, in particular when the luminaire has to produce a relatively high intensity of light radiation in the predetermined zone.

To achieve this object, walls of a less translucent material are embedded in the transparent material of the lighting panel, which walls extend substantially perpendicularly to the plane of the lighting panel and preferably extend over the entire thickness of the lighting panel, i.e. over the thickness of the transparent material of the lighting panel. Such walls were found to be an effective means for further reducing inconvenient light radiation from the lighting panel.

It was found that light radiation that leaves the profiled surface at the front of the lighting panel at a relatively small angle to the plane of the lighting panel, which light radiation causes inconvenient glare, has followed long paths through the material of the lighting panel. Such long paths are possible for certain light rays in the transparent material of the lighting panel, in particular light rays directed at small angles to the plane of the lighting panel. Such light rays appear to be an undesired side effect of the structure of the profiled surface. Such undesired light rays may also be caused by reflection or scattering of light radiation by dust and other particles on the surface of the lighting panel, or by damage or irregularities in the material of the lighting panel.

It is possible to effectively reduce such light radiation at small angles to the plane of the lighting panel by adding a small quantity of light-absorbing pigment to the material of the lighting panel, so that light rays that follow a long path through the material of the lighting panel are absorbed, whereas most light rays, which follow short paths, are hardly absorbed at all. However, the use of walls as described above does not or substantially not affect the light rays following a short path, while light rays are prevented from following a long path that is substantially parallel to the plane of the lighting panel.

The walls may be positioned in parallel or may enclose angles with one another. In one preferred embodiment, mutually parallel walls of a first group of walls are positioned at an angle to mutually parallel walls of a second group of walls, which angle is preferably a right angle. A grid of walls is thus present in which all light rays that are substantially parallel to the plane of the lighting panel are effectively caught.

Preferably, the average thickness of the lighting panel is less than 6 mm, preferably between 1.5 mm and 4 mm, while the distance between neighboring walls is more than four times, and preferably more than eight times, said average thickness of the lighting panel. If the distance between the walls is large relative to the thickness of the lighting panel, any disturbance of the desired light radiation by the lighting panel is minimized.

Preferably, said walls are opaque, so that no light radiation can pass through the walls. An undesired light ray is effectively blocked by the first wall that it meets in that case. In one preferred embodiment, said walls are light-absorbing, while in another preferred embodiment said walls are light-reflecting. It was surprisingly found that also light-reflecting walls reduce the emission of light radiation at relatively small angles to the plane of the lighting panel, while such light-reflecting walls do not affect light radiation that is at relatively wide angles to the plane of the lighting panel.

In one preferred embodiment, the front of the lighting panel is provided with protrusions having a substantially conical surface that tapers from the base portion of the protrusions, which protrusions extend in a direction away from the lighting panel. Conical surface in this description denotes a right circular conical surface. The expression 'substantially conical' means that the protrusions are preferably right circular cones, but may also have a minor deviation from that shape.

Such a profile of the front surface of the lighting panel was found to be very effective in directing the light radiation into the predetermined zone in front of the luminaire, in particular with an apex angle of the substantially conical surface of the protrusions of between 100° and 120°, preferably between 105° and 115°. The shape of the protrusions may deviate slightly from the conical shape, in which case the angle between the axis of the substantially conical shape and a flat plane touching the surface of the protrusion in any location of that surface is preferably between 50° and 60°.

In one preferred embodiment, in top view of the protrusions, the entire circumference of the base portion of each protrusion abuts against similar surrounding protrusions. This means that the substantially conical surfaces of neighboring protrusions intersect each other at a line, which line is an endless line on the surface of the base portion of each protrusion. So, between the protrusions there are no surfaces enclosing an angle with the plane of the lighting panel other than half the apex angle of the substantially conical shape.

The substantially conical surface of the protrusion, which surface tapers from the base portion of the protrusion, may taper into an apex, so that a pointy converging cone extends from the surface of the lighting panel. In one preferred embodiment, however, said substantially conical surface is bordered by an endless edge (or ridge) at a distance from said base portion, such that at the other side of the edge the protrusion has a concave surface that tapers from said edge into an apex. Preferably, the concave surface of the protrusion surrounded by said edge is a conical or a pyramidal surface whose apex angle is between 100° and 120°, preferably between 105° and 115°.

If the concave part of the surface of the protrusion is substantially conical, said endless edge is a circle. If the concave part of the surface is pyramidal, the edge is an endless non-circular line that does not lie in a flat plane, so it is a three-dimensionally curved line.

The invention also relates to a substantially flat translucent lighting panel for a luminaire comprising a light source, wherein the material of the lighting panel is transparent, wherein the front surface of the lighting panel is profiled in order to reduce outgoing light radiation that is at a relatively small angle to the plane of the lighting panel, and wherein walls of a less translucent material are embedded in the transparent material of the lighting panel, which walls extend substantially perpendicularly to the plane of the lighting panel and preferably extend over the entire thickness of the lighting panel.

The invention will now be further elucidated by means of a description of an example of a lighting panel for a luminaire as described above, wherein the inner side of the lighting panel, which side is to be directed towards the light source, has a substantially flat surface, and wherein the other side (outer side) of the lighting panel has a profiled surface, reference being made to the drawing comprising Figures which are only schematic representations, in which.

The front (or outer side) of the lighting panel is the side where the transmitted light radiation leaves the lighting panel. This front of the lighting panel may form the front of the luminaire, i.e. the side where the outgoing light radiation leaves the luminaire. If the luminaire is mounted to the ceiling of a room, the front is the lower side of the luminaire. In the described embodiment, the front (outer side) of the lighting panel is provided with conical protrusions, and the back (inner side) has a flat surface. The Figures show only a portion of the lighting panel. The panel, or plate, may be much larger, but the pattern and shape of the protrusions are the same over the whole front surface of the lighting panel.

Figure 1:
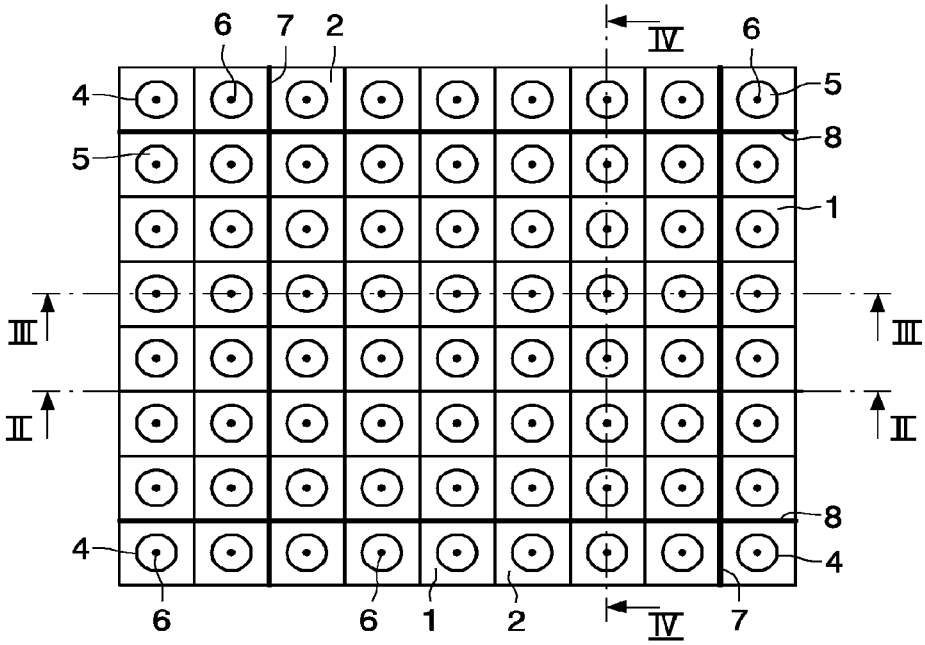
FIG. 1 is a front view of the lighting panel.

FIG. 1 is a front view of the embodiment of the lighting panel, showing the protrusions 1 in plan view. The base portion of each protrusion 1 has a square outer circumferential shape in plan view, and the surface 2 of the base portion is conical. This conical surface 2 surrounds a circular edge 4, which edge extends in a plane parallel to the plane of the lighting panel. The surface 5 at the inner side of the circular edge 4 is concave and also has a conical shape. The concave surface 5 tapers into an apex 6.

The dimensions of the protrusions 1 of the lighting panel may depend on aesthetic considerations. Preferably the distance between the apexes 6 of neighboring protrusions 1 is between 0.5 mm and 10 mm, more preferably between 1 mm and 4 mm. The average thickness of the lighting panel may be about 2 mm.

Figure 2:
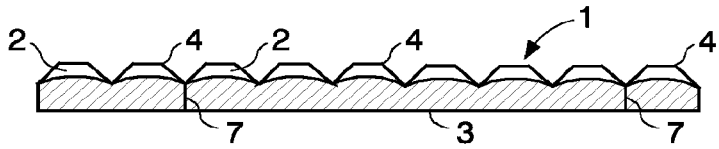
FIG. 2 is a sectional view taken on the line II-II in FIG. 1.
Figure 3:
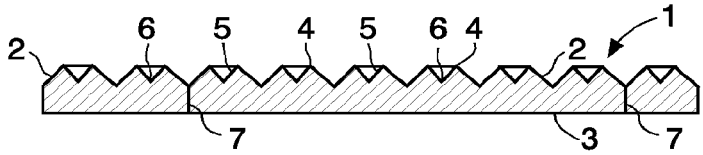
FIG. 3 is a sectional view taken on the line III-III in FIG. 1.
Figure 4:
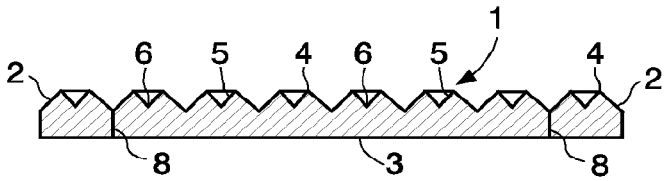
FIG. 4 is a sectional view taken on the line IV-IV in FIG. 1.
Figure 5:
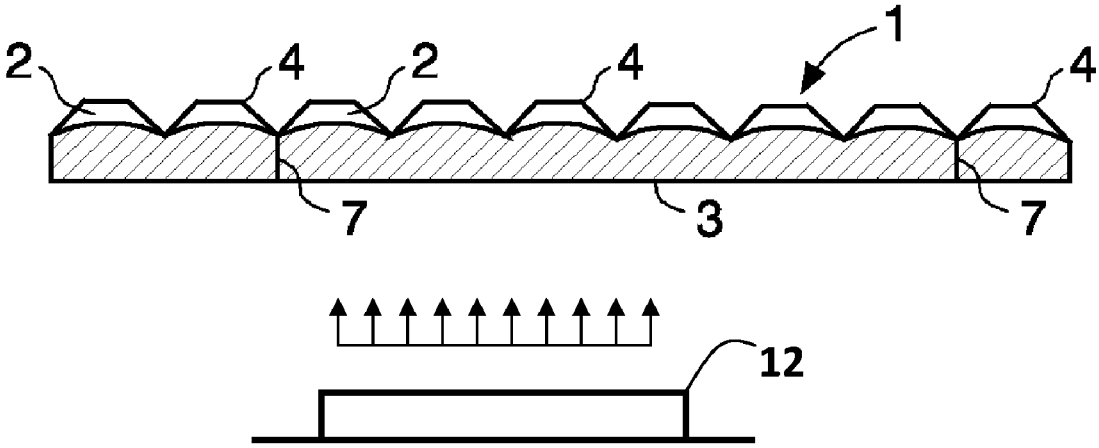
FIG. 5 is a sectional view of a luminaire including the lighting panel shown in FIGS. 1-4 and a light source.

FIGS. 2, 3, and 4 are sectional views, as indicated in FIG. 1 with arrows II, III, and IV, respectively. These sectional views show the flat back 3 of the lighting panel and the protrusions 1 at the front. FIG. 5 is a sectional view of a luminaire including the lighting panel shown in FIGS. 1-4 and a light source 12 emitting light radiation towards the back 3 of the lighting panel.

The lighting panel comprises walls 7, 8 of opaque material, which walls 7, 8 are indicated in the Figures with a bold line. As shown in FIG. 1, the opaque walls 7 are positioned perpendicularly to the opaque walls 8, so that the walls 7, 8 form a grid and divide the material of the lighting panel into square portions, each square portion comprising 36 protrusions 1. FIGS. 2, 3 and 4 show the walls 7, 8 in a sectional view.

The opaque material of the walls 7, 8 is, for example, aluminum, thin strips of aluminum being embedded in the transparent material of the lighting panel. The translucency/transparency of the wall material is less than the translucency/transparency of the material of the lighting panel.

The embodiment of the lighting panel as described above is only an example; a great many other embodiments are possible, in particular ones in which the protrusions have another shape and/or the opaque walls do not form a grid and/or the opaque walls do not follow the structure of the protrusions of the profiled surface.

LIST OF REFERENCE NUMERALS

1 protrusion
2 conical surface of protrusion 1
3 flat back of the lighting panel
4 circular edge
5 surface at inner side of circular edge 4
6 apex
7 opaque walls in the material of the lighting panel
8 opaque walls in the material of the lighting panel

The invention claimed is:

1. A luminaire comprising:

a light source for emitting light radiation and a lighting panel comprising a first material and disposed in front of the light source, the lighting panel defining a plane and having a front surface and a back surface substantially parallel thereto;

wherein the first material is substantially transparent or translucent;

wherein the light radiation emitted by the light source is received at the back surface of the lighting panel and transmitted therethrough towards the front surface;

wherein the lighting panel further comprises a plurality of walls embedded therein and extending from the back surface towards the front surface substantially perpendicularly relative to the plane of the lighting panel, the walls comprising a second material that is less translucent than the first material; and wherein the front surface of the lighting panel is profiled in order to reduce the light radiation emitted from the lighting panel at a relatively small angle relative to the plane of the lighting panel, the front surface comprising a plurality of protrusions having a substantially conical surface that tapers from a base portion of the protrusions, the protrusions extending in a direction away from the lighting panel.

2. A luminaire as claimed in claim 1, wherein mutually parallel walls of a first group of the walls are perpendicular to mutually parallel walls of a second group of the walls.

3. A luminaire as claimed in claim 1, wherein the average thickness of the lighting panel is less than 6 mm, and the distance between mutually adjoining walls is more than said average thickness of the lighting panel multiplied by four.

4. A luminaire as claimed in claim 1, wherein said walls are opaque.

5. A luminaire as claimed in claim 1, wherein said walls are light-absorbing.

6. A luminaire as claimed in claim 1, wherein said walls are light-reflecting.

7. A luminaire as claimed in claim 1, wherein an apex angle of the substantially conical surface of the protrusions is between 100° and 120°.

8. A luminaire as claimed in claim 1, wherein said substantially conical surface is bordered by a ridge at a distance from said base portion.

* * * * *